United States Patent [19]

Fujimori

[11] Patent Number: 4,751,797

[45] Date of Patent: Jun. 21, 1988

[54] ABRASIVE SHEET AND METHOD OF PREPARATION

[75] Inventor: Akira Fujimori, Tokyo, Japan

[73] Assignee: Hi-Control Limited, Hong Kong, Hong Kong

[21] Appl. No.: 913,009

[22] Filed: Sep. 26, 1986

[51] Int. Cl.[4] ..... B24B 11/00

[52] U.S. Cl. ..... 51/395; 51/293

[58] Field of Search ..... 51/395, 396, 397, 293; 106/3

[56] References Cited

U.S. PATENT DOCUMENTS

| | | | |
|---|---|---|---|
| 2,755,607 | 7/1956 | Haywood | 51/395 |
| 3,868,235 | 2/1975 | Held | 51/293 |
| 4,111,666 | 9/1978 | Kalbow | 51/395 |
| 4,142,334 | 3/1979 | Kirsch | 51/395 |
| 4,202,140 | 5/1980 | Alessio | 51/395 |
| 4,255,164 | 3/1981 | Butzke | 51/395 |

*Primary Examiner*—Harold D. Whitehead

*Attorney, Agent, or Firm*—Ladas & Parry

[57] ABSTRACT

An abrasive sheet or polishing sheet containing an abrasive layer divided into discrete blocks by a network of grooves. The polishing sheet is prepared by making a slurry of abrasive particles and a resin adhesive agent of low density and viscosity, spreading it on a base and heating the resulting sheet from below the base.

26 Claims, 2 Drawing Sheets

ABRASIVE SHEET AND METHOD OF PREPARATION

BACKGROUND OF THE INVENTION

The present invention relates to an abrasive layer divided into discrete blocks by a network of grooves, and more particularly, to an improvement in the making of grooves on the abrasive layer.

Various problems exist in the traditional application of plastic sheets evenly coated with abrasive particles as abrasive sheets in surface polishing, as abrasive dust accumulates between the abrasive sheet and the surface of the object, preventing the polishing process from going smoothly.

The traditional abrasive sheets are manufactured by evenly applied abrasive particles mixed with resin adhesive agent on the surface of plastic sheets. When used to polish the surface of metal and other objects, abrasive dust accumulates between the abrasive layer of the abrasive sheet and the surface of the object, preventing proper polishing, and moreover, abrasive particles drop out of the sheet and make scratches on the surface of the object. Finally, as the polishing proceeds, more and more abrasive dust and abrasive particles drop from the object being polished and the abrasive sheet, which dust and particles accumulate and stick to the edges of the object, causing the problem of round-shouldered polished surfaces instead of flat ones. It was, therefore, necessary to remove abrasive dust during the polishing process.

Meanwhile, with the recent use of magnetic heads in computer floppy discs for the input and output of information, a problem arises in that these magnetic heads attract dirt from the part of the floppy disc they contact when used over a long period. To remove the dirt from magnetic heads, an abrasive diskette for lapping and cleaning magnetic recording heads (IBM Technical Disclosure Bulletin, Vol. 20, No. 8, January 1978) was developed. However, problems still exist as the dirt removed in this way would later stick to the magnetic heads again.

For this purpose, there was also developed a cleaning tape for magnetic heads (U.S. Pat. No. 4,138,229) which employs an abrasive layer of particles of two different diameters to collect dirt between the bigger particles. This removes the dirt quite well, but the bigger particles are highly liable to scratch the magnetic heads in lapping; in addition, there is technical difficulty in manufacturing a dispersion of bigger particles evenly among smaller particles in the abrasive layer.

Also developed was mylar tape to which a dacron fabric is bonded by an adhesive layer. The dacron fabric projects and cleans off the dirt from the magnetic head by lapping it mechanically on the surface (U.S. Pat. No. 4,408,241).

But the dacron tape removes only the soft dirt while hard particles and magnetic crystalline powder in the dirt from the magnetic disc in the dirt remain intact.

SUMMARY OF THE INVENTION

It is an object of the present invention to provide an abrasive layer divided into discrete blocks by a network of grooves. For this purpose, a layer of abrasive particles mixed into a slurry form with resin adhesive agent is coated on at least one side of a plastic sheet, and Benard cells form, which depend in size upon the thickness of the layer. The Benard cell is artificially formed by controlling viscosity, surface tension, temperature, density and other factors in the process of drying and hardening the coated layer of given thickness. Consequently the layer on the sheet is divided into a cellular pattern, forming a network of grooves among cells. Abrasive dust is collected in these grooves and then removed for the improvement of polishing effects.

Another object of the present invention is to provide a cleaning sheet for magnetic heads, that is to provide an abrasive sheet, based on the concept of the Benard cells, into the same shape as the floppy disc, so that it can be kept in a jacket, and to lap the disc head by setting in the same way as the floppy disc, i.e., removing the dirt from the disc head by the lapping of abrasive particles, collecting into the network of grooves, cleaning off by a wiper and thereby cleaning the surface of magnetic heads.

The present invention relates to a new abrasive sheet made up of a layer of abrasive particles mixed into a slurry and based upon the concept of so called "Benard cell". Benard cells and the process for their formation have been known for many years (H. Bernard, Revue Generale des Sciences Pures et Appliques 11, 1261, 1309 (1900); J. Thomson, Proc. Phil. Soc. Glasglow 13,464 (1882); C. Normand et al, Rev. Mod. Phys. 49, No. 3, 314 (1977)). The mechanism for forming a "Benard cell" is described in M. G. Velarde and C. Normand's paper entitled "CONVECTION", Scientific American 9, 56 (1980).

The present invention removes the abrasive dust through the grooves among cells, thus making polishing more effective. This new abrasive sheet can be used as an effective cleaning disc for the magnetic head of floppy discs to get rid of the dirt by lapping.

BRIEF DESCRIPTION OF THE DRAWINGS

With reference to the accompanying drawings,

FIG. 4(*b*) is the side view of the cleaning disc along the line II—II of FIG. 4(*a*).

DETAILED DESCRIPTION OF PREFERRED EMBODIMENTS

Traditional polishing sheets are made by mixing abrasive particles and a resin adhesive agent at a viscosity of 100–130 cp and a density of 1.4–1.5 g/cubic cm to form a slurry, which is then spread evenly on a base of plastic sheet, to be dried and hardened at a temperature below 80 degrees C. When slurry of such high viscosity is dried at relatively low temperatures, it will not flow or undergo convention, but simply harden and form an even and flat polishing layer on the base.

Figure 1:
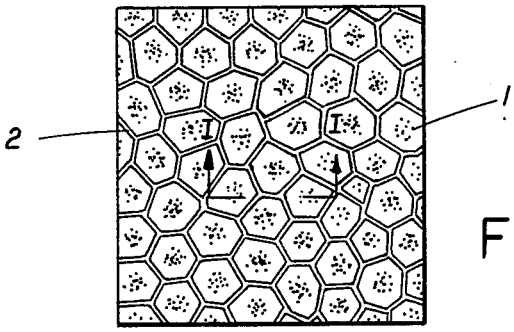
FIG. 1 is the top view of the abrasive sheet formed with the Benard cells.

This invention is different from the traditional polishing sheet in that a slurry of relatively low viscosity (60–90 cp) and low density (1.1–1.3 g/cubic cm) is spread on the base, where it retains its fluidity. In the drying and hardening process heating is done from below the base at temperatures higher than that traditionally used. Thus, the fluid slurry undergoes convection and it becomes possible to make polishing sheets with artificially generated Benard cells as shown in FIG. 1, where (1) is a cell and (2) is a mesh-like groove between the cells.

The following is a detailed description of the method of making polishing sheets in this invention and the generation of Benard cells.

Figure 2:
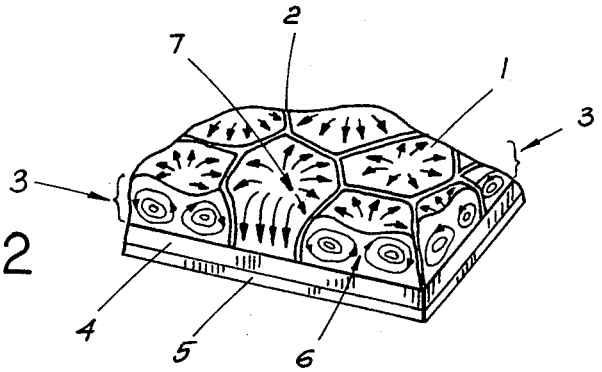
FIG. 2 is the side view taken along the line I—I of FIG. 1, the arrow indicating the direction of the slurry flow.

As shown in FIG. 2, a polishing layer (3) of a certain thickness is spread on at least one side of the base (4), which is 16–100 micron in thickness and is made of polyester resin or other plastic sheet. As an example, a fluid slurry is made by mixing $Cr_2O_3$ or $Al_2O_3$ as polyester resin adhesive agent and abrasive particles (average particle diameter 0.3–1 micron) to be spread on base (4) at a thickness of 10–20 microns. In traditional polishing sheets, a slurry of 1.4–1.5 g/cubic cm density and a high viscosity (100–130 cp) is spread on base (4). In this invention, to generate Benard cells as shown in FIG. 1, a fluid slurry with a low viscosity must be made.

Figure 3:
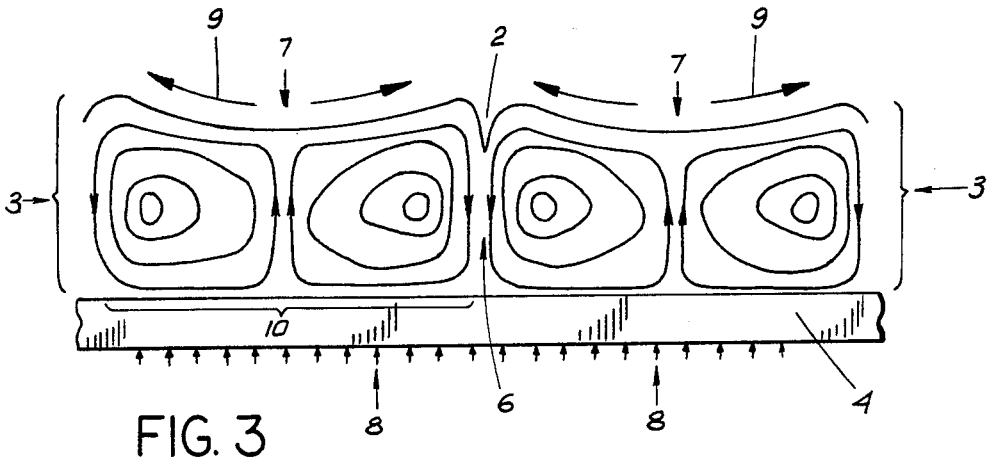
FIG. 3 is an enlarged side view of the abrasive layer, showing formation of the Benard cells.

To do so, more quantities of organic solvent are mixed into the resin adhesive agent and abrasive particles to lower the viscosity of the slurry to 60–90 cp and the density to 1.1–1.3 g/cubic cm so that it retains its fluidity when spread on base (4). Then heat is applied from below the base. Before the slurry is dried and hardened, convection is confirmed. The conditions for making traditional polishing sheets are to keep the viscosity of the slurry high, the temperature for drying and hardening low (below 80 degrees C.), so that slurry convection does not take place and the polishing layer remains even during spreading. In this invention, however, slurry layer (3) is heated from below base (4) with a heat source of 90–140 degrees C. as shown in FIG. 3. In this way, the heat convection is in the direction of arrow (8) and the temperature of base (4) rises before the lower part of slurry layer (3) which is in contact with base (4). As the temperature of the lower part of the slurry is high, the density is low; whereas since the temperature of the upper part of the slurry is low, the density is high. This creates an unstable condition in which light slurry lies below heavy slurry. Thus heavy slurry begins to move down and light slurry begins to move up to restore stability, and this gives rise to the convection in slurry layer (3) in the direction of arrow (6) as shown in FIG. 3, which generates hexagonal cell patterns. In the center of the cell (7), heated slurry becomes lighter and begins to rise to the top, where it is cooled and moves to the edge of the cells only to be further cooled down. As the density increases it becomes heavy and sinks down to cause convection in the direction of arrow (6).

In the meantime, the surface tension of the slurry also undergoes changes. As the temperature of the slurry rising up in the center is high, the surface tension is low, so the surface in the center stretches; whereas, when the temperature of the slurry at the edge of the cells is low and the surface tension is high the surface shrinks and swells up. In this way the temperature difference between the center and edge of the cells caused by the convection generates a difference in surface tension. Thus the force works in the direction of arrow (9) in FIG. 3 to push the cells at the edge up, forming deep mesh-like grooves between the cells. The diameter (10) of the cells is about double that of the thickness of the slurry layer (3). This can be easily understood from the mode pattern of the convection indicated by the arrow in FIG. 3.

Since the dust of the polished object and loose abrasive particles are removed by the mesh-like grooves on the polishing sheet with Benard cells, various objects can be effectively polished without scratching the polished surface. To facilitate polishing, adhesive layer (5) of polyvinyl alcohol binding agent or gum paste is applied under base (4) in FIG. 2 for attachment on a lapping disk.

Figure 4A:
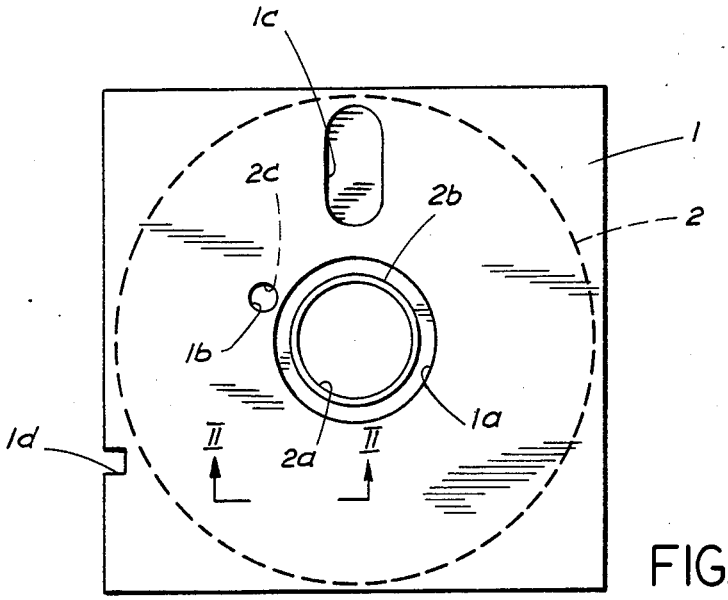
FIG. 4(*a*) is a magnetic head cleaning disc made of an abrasive sheet with Benard cell in a jacket.
Figure 4B:
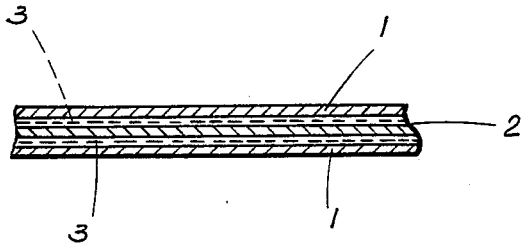

FIG. 4 (*a*) and (*b*) shows application of this polishing sheet as a cleaning disk for magnetic heads. In the figure, (1) is a jacket with a polishing sheet (2) inside. (1*a*), (1*b*) and (1*c*) are holes in jacket (1) for exposing polishing sheet (2); (1*d*) is a check for setting the jacket; (2*a*) and (2*c*) are respectively a hole and an index hole on the polishing sheet for drive handling; (2*b*) is a ring for reinforcing the polishing sheet; and (b) is a cross-section of (a) along the line II—II. In the figure, (1) is the jacket, (2) is the polishing sheet, and (3) is the wiper cleaner for cleaning the dirt from the magnetic head collected in the mesh-like grooves.

I claim:

1. A method for preparing an abrasive sheet comprising (a) preparing a slurry of abrasive particles and a resin adhesive agent of low viscosity and density;

(b) spreading the slurry on a base;

(c) heating the resulting sheet from below the base the abrasive sheet comprising a Benard cell pattern.

2. A method as in claim 1 wherein said low viscosity comprises 60–90 cp.

3. A method as in claim 1 wherein said low density comprises 1.1–1.3 g/cubic cm.

4. A method as in claim 1 wherein said base is 16–100 microns in thickness.

5. A method as in claim 1 wherein said base comprises a plastic sheet.

6. A method as in claim 1 wherein said heating occurs at a temperature of 90°–140° C.

7. A method as in claim 5 wherein said plastic comprises polyester.

8. A method as in claim 1 wherein said abrasive particles have a particle diameter of 0.3–1 microns.

9. A method as in claim 8 wherein said abrasive particles comprise $Cr_2O_3$ and $Al_2O_3$ as abrasive particles.

10. The method, as in claim 1 wherein the low viscosity comprises 60–90 cp, the low density comprises 1.1–1.3 glcubic temperature of 90°–140° C.

11. A polishing sheet comprising a base, and an abrasive material polishing layer on said base sheet, said polishing layer being divided into discrete Benard cell blocks by a network of grooves.

12. A polishing sheet, as in claim 11 wherein the Benard cell pattern is uniformly distributed throughout the sheet.

13. A polishing sheet as in claim 11 wherein the base is a plastic sheet.

14. A polishing sheet, as in claim 11 wherein the abrasive particles have a particle diameter of 0.3–1 microns.

15. A polishing sheet, as in claim 11 wherein the abrasive particles are selected from the group consisting of $Cr_2O_3$ and $Al_2O_3$.

16. A polishing sheet, as in claim 11 wherein the base is 16–100 microns thick.

17. The polishing sheet, as in claim 11, wherein said Benard cell pattern is a hexagonal cell pattern.

18. The polishing sheet, as in claim 12 wherein the base is a plastic sheet.

19. The polishing sheet, as in claim 12 wherein the abrasive particles are selected from the group consisting of $Cr_2O_3$ and $Al_2O_3$.

20. A polishing sheet, prepared by (a) preparing a slurry of abrasive particles and a resin adhesive agent of low viscosity and density;

(b) spreading the slurry on a base;

(c) heating the resulting sheet from below the base the abrasive sheet comprising a Benard cell pattern.

21. A polishing sheet as in claim 20 wherein said low viscosity comprises 60–90 cp.

22. A polishing sheet as in claim 20 wherein said low density comprises 1.1–1.3 g/cubic cm.

23. A polishing sheet as in claim 20 wherein said base is 16–100 microns in thickness.

24. A polishing sheet as in claim 20 wherein said heating occurs at a temperature of 90°–140° C.

25. A polishing sheet as in claim 20 wherein said abrasive particles have a particle diameter of 0.3–1 microns.

26. A polishing sheet comprising a base and a polishing layer, the base being coated on at least one side with a layer of abrasive particles mixed into a slurry with a resin adhesive agent and formed into Benard cells.

* * * * *